US007247101B2

(12) United States Patent
Maurer

(10) Patent No.: US 7,247,101 B2
(45) Date of Patent: Jul. 24, 2007

(54) BILLIARD TARGET PRACTICE DEVICE

(76) Inventor: David L. Maurer, 3755 Brooke Fall Landing, Suwanee, GA (US) 30024

( * ) Notice: Subject to any disclaimer, the term of this patent is extended or adjusted under 35 U.S.C. 154(b) by 715 days.

(21) Appl. No.: 10/365,316

(22) Filed: Feb. 12, 2003

(65) Prior Publication Data

US 2004/0157671 A1 Aug. 12, 2004

(51) Int. Cl.
*A63D 15/00* (2006.01)

(52) U.S. Cl. ..... 473/17; 473/2

(58) Field of Classification Search ..... 473/31, 473/2, 17, 23, 3, 18, 140, 151, 152, 153, 473/154, 155, 32, 15, 1
See application file for complete search history.

(56) References Cited

U.S. PATENT DOCUMENTS

| | | | | | |
|---|---|---|---|---|---|
| 278,341 | A | * | 5/1883 | Kelly | 473/3 |
| 1,150,517 | A | * | 8/1915 | Hawks | 473/3 |
| 1,206,203 | A | | 11/1916 | Brockway | |
| 3,445,112 | A | * | 5/1969 | Fritz | 473/293 |
| 3,463,593 | A | * | 8/1969 | Horan | 473/2 |
| 3,561,563 | A | | 2/1971 | Harsh | |
| 4,524,969 | A | * | 6/1985 | Erzmoneit | 473/17 |
| 4,872,687 | A | * | 10/1989 | Dooley | 473/152 |
| 4,969,620 | A | | 11/1990 | Plummer | |
| 5,171,012 | A | * | 12/1992 | Dooley | 273/118 A |
| 5,171,013 | A | * | 12/1992 | Dooley | 273/118 A |
| 5,234,379 | A | * | 8/1993 | Zotos | 473/2 |
| 5,255,916 | A | * | 10/1993 | Bleich | 273/118 D |
| 5,267,715 | A | | 12/1993 | Owen | |
| 5,275,398 | A | * | 1/1994 | Compton | 473/2 |
| 5,330,188 | A | * | 7/1994 | Reimers | 473/151 |
| 5,338,262 | A | * | 8/1994 | Hayes | 473/2 |
| 5,520,581 | A | * | 5/1996 | Mazzoli | 473/2 |
| 5,738,595 | A | * | 4/1998 | Carney | 473/209 |
| 6,224,029 | B1 | | 5/2001 | Marble et al. | |
| 6,244,970 | B1 | * | 6/2001 | Sullivan et al. | 473/53 |
| 6,390,471 | B2 | * | 5/2002 | Shinbo et al. | 273/126 A |
| 6,582,316 | B2 | | 6/2003 | Tompert | |
| 6,769,992 | B1 | * | 8/2004 | Domulevicz et al. | 473/2 |
| 6,827,651 | B1 | * | 12/2004 | Davis | 473/2 |

* cited by examiner

*Primary Examiner*—Robert E. Pezzuto
*Assistant Examiner*—Travis Banta
(74) *Attorney, Agent, or Firm*—Jason A. Bernstein; Charles L. Warner, II; Powell Goldstein LLP

(57) ABSTRACT

An apparatus for billiards practice, comprising a housing; an emitter connectively disposed to the housing; a pair of detectors equally spaced about the emitter; a controller having logic controlling the emitter; at least one indicator in communication with the logic; the logic receiving at least one signal from the detectors via the emitter projecting the signal onto the surface of the billiards ball; the logic resolving the position of the billiards ball with respect to the emitter in concert with the detectors; and a response to the logic resolved position of the billiards ball via the indicator. The player's instant feedback is implemented via a controller disposed within the billiards practice device. The controller has means to emit infrared signals and capture the return reflected infrared signal from the cue ball. The returned infrared signals are interpreted and processed via the controller. Once processing is complete, the controller has means to notify the player as to the execution of his shot via at least one indicator(s).

21 Claims, 3 Drawing Sheets

BILLIARD TARGET PRACTICE DEVICE

FIELD OF THE INVENTION

The invention relates, in general, to a mechanism mountable on a billiard table or other structure for providing information. In particular, the invention relates to a mechanism that acquires data from the billiard table as to accuracy of a billiard ball impacting a raised cushion railing of the billiard table. More particularly, the invention relates to an instant feedback system indicating to the billiard player as to the accuracy of a billiard ball impacting the raised cushion railing of the billiard table.

BACKGROUND OF THE INVENTION

Billiards referred to herein encompasses a plurality of different games, such as, but not limited to, three ball, eight ball, nine ball, Snooker or any other type of game played on a rectangular or other geometric shaped cloth-covered table with raised cushioned edges, in which a cue is used to hit a hard ball (cue ball) against another ball or the side cushions of the table.

The game of billiards is continuing to grow in popularity. According to the Sporting Goods Manufacturing Association's January 2002 State of the Industry Report, there were 37.5 million players in the U.S. alone. Approximately 7% of those are "devoted" players (playing more than twice per week). Almost all of these players have a desire to improve their game. Billiards is a game of skill and accuracy. In addition to understanding the basics of the game and the geometry of the shots, players must also develop the skill to shoot well with the proper amount of force, correct aim and English. English is defined as the spin given to a ball by striking it on one side or releasing it with a sharp twist.

Developing the correct aim is a daunting task for the causal and avid players of billiards. There are many factors to consider in aligning the cue with the cue ball and an intended target. The intended target may be another ball or one or more of the raised cushioned rails that enclose the billiard table. Further, the player must consider the distance to the intended target and their own skill level in executing the shot. Unfortunately, many factors can affect a shot and if the player's shot is unsuccessful, he is left wondering what went wrong. Did he miss his desired target point? Was his desired target point in error? Was there too much (or too little) English? Indeed, even if the player makes his shot, aim could have still been off slightly but not enough to cause a missed shot.

It would be desirable for the causal or avid billiard player to receive instant feedback as to the accuracy of his shot. The feedback would enable the player to improve his skill level by providing immediate information as to where the cue ball struck the intended target, i.e., another ball or one or more of the raised cushioned rails that enclose the billiard table, thus allowing the player to make appropriate corrective actions on subsequent shots.

SUMMARY OF THE INVENTION

The present invention is a billiards practice device or monitoring device. The present invention may, if desired, be positioned along one of the rails of the billiard table. The present invention comprises at least one infrared emitter and a pair of infrared sensors. The infrared emitter is focused outwardly across the top surface of the billiard table. The infrared sensors are selectively positioned in such a manner as to receive reflected infrared signals from an object, i.e., the cue ball at or near the rail of the billiard table. In combination, the infrared emitter and sensors form a field-of-view that extends from the railing of the billiard table to a select distance disposed on the top surface of the billiard table. Once the cue ball enters the field-of-view, it reflects the infrared signal impinging on its surface. The reflected infrared signals positionally denote the cue ball in relation to the railing and the infrared sensors, i.e., the infrared signals represent data that is captured by the infrared sensors, interpreted and processed by the present invention.

The present invention includes a controller disposed within the monitoring device. The controller has a program stored in memory that commands and controls the operational features of the present invention. The controller receives, interprets and processes the data. Based on the interpretation of the processed data the controller directs at least one indicator disposed on the monitoring device to notify the billiard player whether the intended shot was on target as planned, i.e., directly aligned with the infrared emitter or if it was spaced to the left or to the right of the infrared emitter.

When taken in conjunction with the accompanying drawings and the appended claims, other features and advantages of the present invention become apparent upon reading the following detailed description of embodiments of the invention.

BRIEF DESCRIPTION OF THE DRAWINGS

The invention is illustrated in the drawings in which like reference characters designate the same or similar parts throughout the figures of which.

DETAILED DESCRIPTION OF THE INVENTION

Figure 1A:
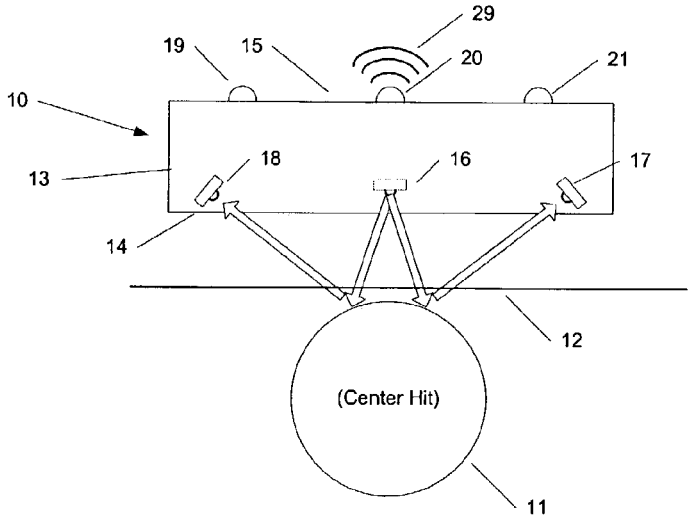
FIG. 1*a* illustrates a schematic view and the operation of the preferred embodiment of the present invention when the cue ball impacts a raised cushioned rail of a billiard table on the desired target point.

One embodiment of the present invention as shown in FIG. 1*a* is a billiard practice device 10 used to aid the billiard player in the execution of hitting the cue ball 11 in a desired manner such that the cue ball 11 strikes a raised cushioned edge(s) 12 at an intended point.

The device 10 is preferably positioned along one of the raised cushioned edges 12. Preferably, the device 10 is positioned along one of the short sides of the rectangular cloth-covered table. The device 10 may, if desired, be enclosed in any type of housing 13 that enables the device 10 to be positioned on any of the raised cushioned edges 12 of the rectangular cloth-covered table. The housing 13 has a front wall 14. The front wall 14 faces in the direction of the top surface of the rectangular cloth-covered table. An infrared emitter 16 is positioned along the front wall 14 of the housing 13. Any position may be selected for the placement of the infrared emitter 16 on the front wall 14. A pair of infrared sensors 17 and 18 are selectively positioned about the infrared emitter 16. The pair of infrared sensors 17 and 18 are selectively positioned with respect to the infrared emitter 16 to enable a desired field-of-view adjacently spaced from the raised cushioned edges 12. For example, the device 10 is positioned with a field-of-view coinciding or contiguous with the raised cushioned edges 12. The sensors 17 and 18 in concert with the infrared emitter 16 construct the focal point at the edge of the raised cushion 12. If desired, the device 10 field-of-view may be extended to any convenient point on the rectangular cloth-covered table by selectively spacing the infrared sensors 17 and 18 with respect to the infrared emitter 16 to have the focal point of the field-of-view converge at a desired point on the table.

During a practice session, the billiard player strikes or hits the cue ball 11 with the intent of the cue ball 11 striking the raised cushioned 12 at a point aligned with the infrared emitter 16. When the cue ball 11 enters the field-of-view of the device 10, the infrared signal impinging the surface of the cue ball 11 is reflected towards the infrared sensors 17 and 18. The received infrared signal is interpreted and processed by the device 10. The device 10 has at least one indicator mounted onto the rectangular housing 13. The device 10 directs the indicator to notify the billiard player whether the intended shot was on target as planed, i.e., directly aligned with the infrared emitter 16 or if it was spaced to the left or to the right of the infrared emitter 16.

The housing 13 may if desired, be substantially rectangular or any or other convenient geometric shape. The housing 13 has a front wall 14, a rear wall 15, a top wall 24 and bottom wall 25 (not shown) forming the enclosure for the device 10. The housing 13 may, if desired, be fabricated from any convenient material. Examples of convenient materials are metal, wood, plastic, ceramic, composite, a polymer or mixtures or composites of the foregoing. The bottom wall 25 engages the raised cushioned edges 12 of the rectangular cloth-covered table. The bottom wall 25 may, if desired, be affixed to the raised cushioned edges 12 by any convenient means, such as, but not limited to, double sided adhesive tape, hook and loop fastener or sufficient weight added to the housing 13 to secure it in a selected position along the raised cushioned edges 12.

Figure 1B:
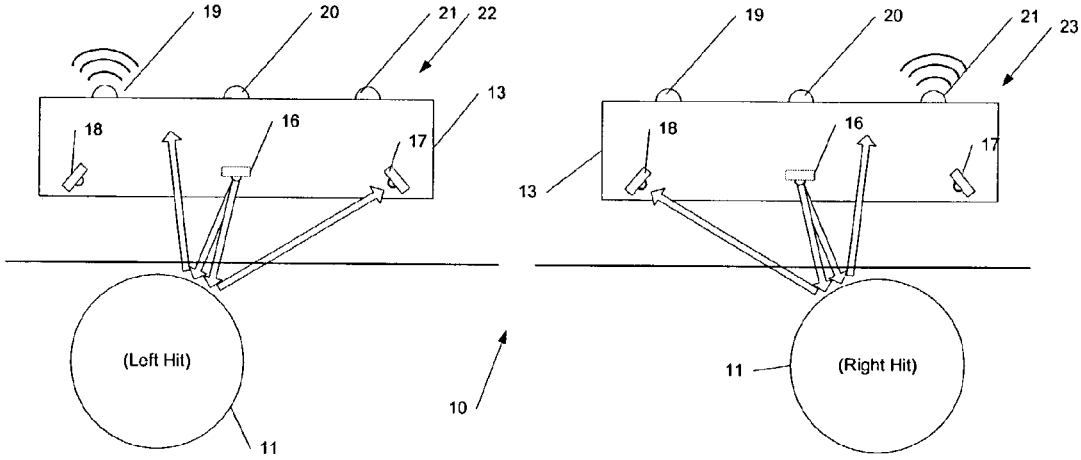
FIG. 1*b* illustrates a schematic view and the operation of the present invention when a cue ball impacts a raised cushioned rail of a billiard table to the left or right of the desired target point.

Infrared emitter 16 and infrared sensors 17 and 18 are mounted inside housing 13 along front wall 14. Front wall 14 is fabricated from a material that is transparent to infrared light that is emitted by infrared emitter 16. The indicator may, if desired, be a series of lights 19, 20 and 21 mounted onto the top wall 24. The light 20 indicates the intended shot was on target as depicted in FIG. 1*a* and lights 19 and 21 indicate the shot was to the left 22 or to the right 23 of the intended target, as shown in FIG. 1*b*. Additionally, an audio indicator may, if desired, emit a distinctive audible tone indicating whether the intended shot was on target or if the shot was to the right or left of the intended target. Further, a digital numeric display may, if desired, indicate the exact distance from the intended target to the actual point of impact of the cue ball 11 with the raised cushioned edges 12.

Figure 2:
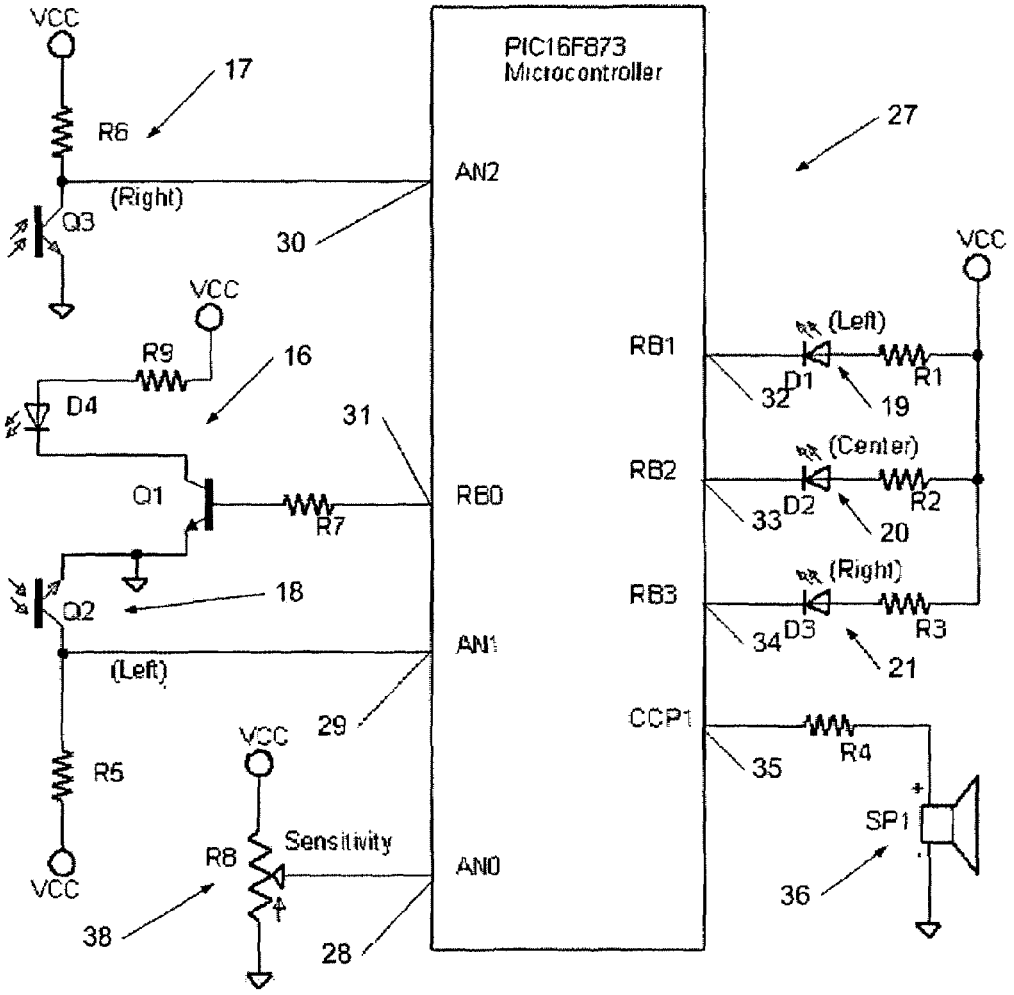
FIG. 2 illustrates an electrical schematic view of the present invention depicted in FIG. 1*a*.

The intelligence for commanding and controlling the device 10 resides in a microcontroller 27, as shown in FIG. 2. The microcontroller 27 has an internal memory wherein a program is stored containing a plurality of instructions that command and control the device 10. The command and control of the present invention 10 is implemented via a first Analog-to-Digital port 28 in communication with a sensitivity control 38, a second Analog-to-Digital port 29 in communication with infrared sensor 18 and a third Analog-to-Digital port 30 in communication with infrared sensor 17. Further, implementation is provided via a first digital port 31 in communication with infrared emitter 16, a second digital port 32 in communication with the left of target indicator 19, a third digital port 33 in communication with the center of target indicator 20 and a forth digital port 34 in communication with a right of target indicator 21. Further implementation is provided via a pulse width modulator output port 35 in communication with an audible tone generator 36.

Any convenient microcontroller that enables the device 10, as shown in FIG. 2, to function as delineated herein may be used. An example of a suitable microcontroller is a PIC 16F873 microcontroller manufactured by Microchip Technology of Chandler, Ariz. The PIC16F873 microcontroller has three Analog-to-Digital ports, four digital ports and a PWM port 35 for sound generation.

Figure 3A:
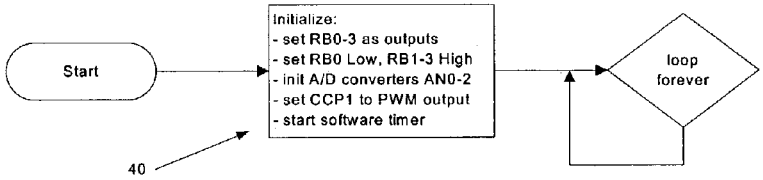
FIG. 3*a* illustrates a top level view of a command and control flow chart of the program stored in the microcontroller of FIG. 2.
Figure 3B:
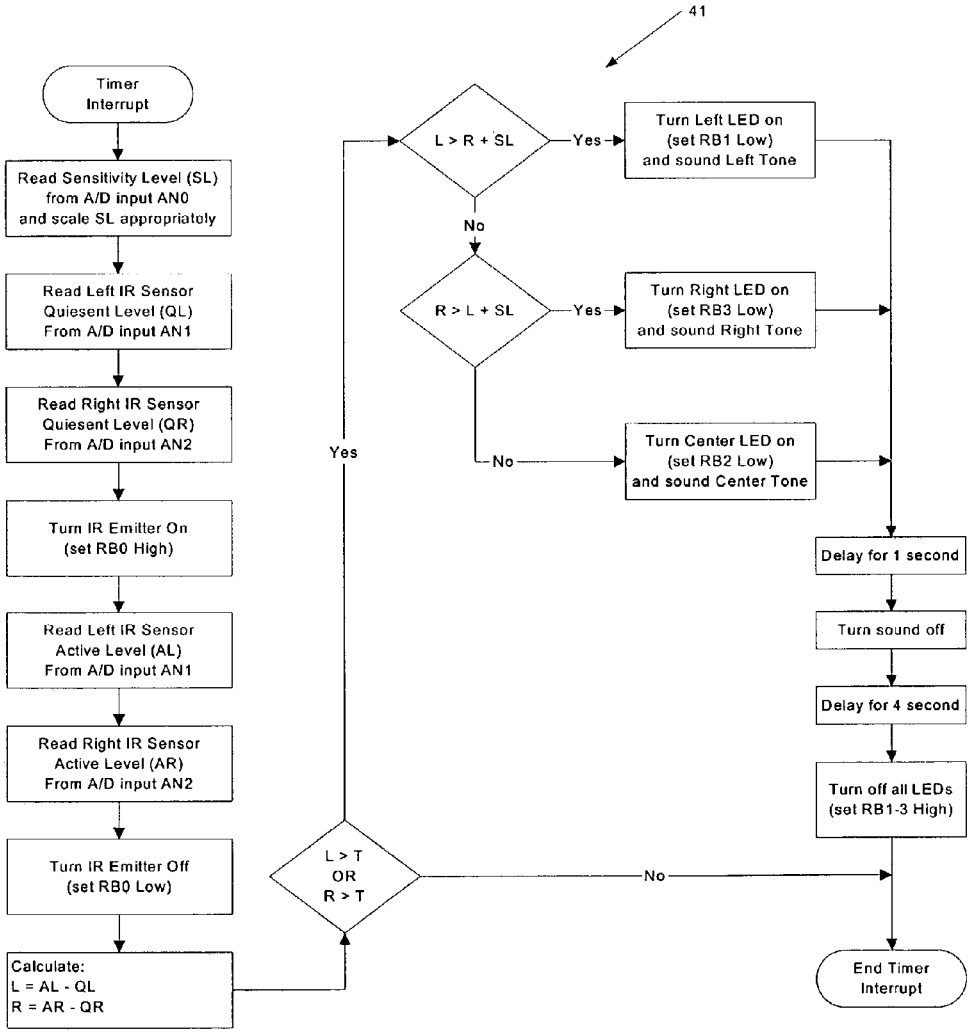
FIG. 3*b* illustrates a top-level view of the timer interrupt flow chart detailing program code that is executed when the software timer interrupt of FIG. 3*a* occurs.

The controlling program stored in the microcontroller 27 memory has as its fundamental premise the comparing of ambient light to the reflected light from within the field-of-view of the device 10. The device 10 is initialized 40, as shown in FIG. 3*a*, by configuring digital ports 31, 32, 33 and 34 as output ports to drive emitter 16 and indicators 19, 20 and 21, respectively. The Analog-to-Digital ports 28, 29 and 30 are activated to receive incoming data. A microcontroller 27 internal timer is activated to generate periodic interrupts that will execute instructions 41 of FIG. 3*b* to acquire and process incoming data from the Analog-to-Digital ports 28, 29 and 30. Once the initialization is complete and the timer activated, the program then sits in an infinite loop.

Upon Timer Interrupt, the device 10 is commanded 41 to acquire data from the field-of-view of the infrared sensors 17 and 18. The acquired data comprises two sets of readings from each sensor (a total of four readings). The readings are compared to determine if the cue ball 11 is in the field-of-view of the infrared sensors 17 and 18. The first pair of readings is performed with infrared emitter 16 turned off and the infrared sensors 17 and 18 receiving data. The data received by the infrared sensors 17 and 18 represents the ambient light level in the area adjacent to the field-of-view. The second pair of readings is performed with the infrared emitter 16 turned on. If the cue ball 11 is within the field-of-view of the infrared sensors 17 and 18 the second reading data increases significantly. By comparing the amplitudes of the increase, the program may determine where the cue ball 11 engaged the raised cushioned edge 12. If the data obtained from the infrared sensors 17 and 18 is of equal magnitude or within a band defined by the sensitivity control 38, the shot is considered to be on target. The indicator 20 may, if desired, be illuminated and the audible tone generator 36 may be activated. If the data obtained from the infrared sensors 17 and 18 is of unequal magnitude, the program determines if the shot is to the right or the left of the center and commands the appropriate indicator 19 or 21 to be activated. The activation may, if desired, be the same or different from the on target indicator 20.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. Means-plus-function clause is intended to cover the structures described herein as performing the recited function and not only structural equivalents but also equivalent structures. All patents, applications and publications mentioned herein are incorporated by reference in their entirety.

I claim:

1. An apparatus for billiards practice, billiards comprising a billiard table having railings, the table having at least one billiard ball disposed thereon, a monitoring device positioned along one of the railings, the monitoring device having disposed therein a controller with memory, a program stored within the memory, the program having a plurality of data structures commanding and controlling the apparatus, the apparatus having a transmitting device and at least a pair of receiving devices to establish a field of view focused onto the table, the apparatus comprising:

a) at least one communication data structure receiving at least one signal from at least one of the receiving devices, the receiving devices being responsive to a signal emitted by the transmitting device and reflected by the billiard ball;

b) at least one responsive data structure transforming said at least one signal into indicator data;

c) at least one determining data structure interpreting said indicator data to determine the position of the billiard ball within the field of view; and d) at least one broadcast data structure transforming said determined position of the billiard ball into a positional indicator of the billiard ball within the field of view.

2. The apparatus of claim 1, further comprising:

a) at least one resolving data structure interpreting said indicator data as absence of the billiard ball from the field of view;

b) said resolving data structure transforming the absence of the billiard ball from the field of view into base level data;

c) said determining data structure in communication with said resolving data structure;

d) said determining data structure calculating said determined position of the billiard ball within the field of view via said base level data.

3. The apparatus of claim 1, wherein said broadcast data structure transforms said determined position into said positional indicator to indicate said billiard ball is to the center of the field of view.

4. The apparatus of claim 1, wherein said broadcast data structure transforms said determined position into said positional indicator to indicate said billiard ball is to the right of the center of the field of view.

5. The apparatus of claim 1, wherein said broadcast data structure transforms said determined position into said positional indicator to indicate said billiard ball is to the left of the center of the field of view.

6. The apparatus of claim 1 wherein the communication data structure is configured to receive signals from at least two of the receiving devices, the responsive data structure is configured to transform said at least two signals into said indicator data, and said determining data structure is configured to compare said indicator data from said at least two signals to determine the position of the billiard ball within the field of view.

7. The apparatus of claim 1 wherein the communication data structure is configured to receive signals from at least two of the receiving devices, the responsive data structure is configured to transform said at least two signals into said indicator data, and said determining data structure is configured to determine the position of the billiard ball within the field of view using a sensitivity level and said indicator data from said at least two signals.

8. An apparatus for billiards practice, billiards comprising a billiard table having railings, the table having at least one billiard ball disposed thereon, the apparatus comprising:

a) a housing;

b) an emitter connectively disposed to said housing to provide an emitted signal;

c) a pair of detectors equally spaced about said emitter to provide received signals, said pair of detectors being responsive to said emitted signal reflected by said billiard ball to provide said received signals, said emitter and said pair of detectors providing a field of view with respect to said table;

d) a controller having logic controlling said emitter;

e) at least one indicator in communication with said logic;

f) said logic receiving at least one received signal from said detectors;

g) said logic resolving the position of the billiard ball with respect to said field of view; and h) said indicator providing a response indicating said logic resolved position of the billiard ball.

9. The apparatus of claim 8, wherein said emitter is an infrared emitter.

10. The apparatus of claim 8, wherein said logic resolving the position of the billiard ball causes said indicator to indicate said billiard ball is to the center of said field of view.

11. The apparatus of claim 8 wherein said logic resolving the position of the billiard ball causes said indicator to indicate said billiard ball within said field of view and is either to the right of center or to the left of center of said field of view.

12. The apparatus of claim 8, wherein said response is an audible tone emitted via said indicator.

13. The apparatus of claim 8, wherein said response is a light emitted via said indicator.

14. The apparatus of claim 8, wherein said response is a digital distance reading via said indicator.

15. The apparatus of claim 8, wherein said controller turns off said emitter, wherein said logic is further responsive to said received signals when said emitter is off to determine the ambient signal level received by the detectors, and wherein said logic is also responsive to said ambient signal level to resolve the position of the billiard ball.

16. The apparatus of claim 8 wherein said logic is configured to receive at least two signals from at least two said detectors and to resolve said position based upon a comparison of said at least two signals.

17. The apparatus of claim 8 wherein said logic is configured to receive at least two signals from at least two said detectors and to resolve said position a sensitivity level and said at least two signals.

18. An apparatus for billiards practice, billiards comprising a billiard table having railings, the table having at least one billiard ball disposed thereon, a monitoring device positioned along one of the railings, the monitoring device having disposed therein a controller with memory, a program being stored within the memory, the program having a plurality of data structures commanding and controlling the apparatus, the apparatus having a transmitting device and at least a pair of receiving devices to establish a field of view focused onto the table, the apparatus comprising:

a) a housing;

b) the transmitting device being an emitter connectively disposed to said housing;

c) the receiving devices being a pair of detectors equally spaced about said emitter and being responsive to said emitted signal reflected by said billiard ball to provide received signals;

d) at least one communication data structure to receive at least one received signal from the receiving devices;

e) at least one responsive data structure transforming said at least one received signal into indicator data;

f) at least one determining data structure interpreting said indicator data, said determining data structure determining the position of the billiard ball within the field of view;

g) at least one broadcast data structure transforming said determined position of the billiard ball into a center position of the billiard ball within the field of view;

h) a resolving data structure transforming the absence of the billiard ball from the field of view into base level data;

i) said determining data structure in communication with said resolving data structure; and j) said determining data structure calculating said determined position of the billiard ball within the field of view via said base level data.

19. The apparatus of claim 18, wherein said controller turns off said emitter, wherein said program further has an ambient data structure responsive to said received signals when said emitter is off to determine the ambient signal level received by the detectors, and wherein the determining data structure is also responsive to said ambient signal level to determine the position of the billiard ball.

20. The apparatus of claim 18 wherein said communication data structure is configured to receive at least two received signals from at least two said receiving devices, the responsive data structure is configured to transform said at least two received signals into said indicator data, and said determining data structure is configured to compare said indicator data from said at least two received signals to determine the position of the billiard ball within the field of view.

21. The apparatus of claim 18 wherein said communication data structure is configured to receive at least two received signals from at least two said receiving devices, the responsive data structure is configured to transform said at least two received signals into said indicator data, and said determining data structure is configured to determine the position of the billiard ball within the field of view using a sensitivity level and said indicator data from said at least two received signals.

* * * * *